US006474518B1

(12) United States Patent
Diaz-Acosta et al.

(10) Patent No.: US 6,474,518 B1
(45) Date of Patent: Nov. 5, 2002

(54) CHILDREN'S SHOEHORN

(76) Inventors: Jesus Diaz-Acosta, 330 SW. 43rd St., Ste. K, San Luis, AZ (US) 85349; Diana Berenice Robles-Vidal, 23311 S. Main St. 990-44, San Luis, AZ (US) 85349

( * ) Notice: Subject to any disclaimer, the term of this patent is extended or adjusted under 35 U.S.C. 154(b) by 0 days.

(21) Appl. No.: 09/991,605

(22) Filed: Nov. 23, 2001

(51) Int. Cl.[7] ..... A47G 25/82
(52) U.S. Cl. ..... 223/118; 223/119
(58) Field of Search ..... 223/118, 119; D2/642

(56) References Cited

U.S. PATENT DOCUMENTS 990,283 A * 4/1911 Merrow ..... 223/118
D75,018 S * 5/1928 Douglass ..... D2/642
2,171,310 A * 8/1939 Morgan ..... 223/118
4,865,045 A * 9/1989 Monreal ..... 128/740
D318,172 S * 7/1991 Filipovic ..... D2/642
D382,686 S * 8/1997 Litwin et al. ..... D2/642
6,318,607 B1 * 11/2001 Koskela ..... 223/118

* cited by examiner

*Primary Examiner*—Rodney M. Lindsey
*Assistant Examiner*—James G Smith

(57) ABSTRACT

The present invention provides a children's shoehorn that essentially comprises a lower heel-engaging portion and an upper portion. The shoehorn may be sized for an infant's or child's heel. The upper portion may be in a shape suitable for children. The shoehorn may comprise a circuit having a switch, a battery, a speaker, and microprocessor comprising a memory that enables a song or other distinctive sound to be emitted from a speaker to play a song or other distinctive sound to be emitted from a speaker when a button is pressed. The shoehorn may comprise lightable lights in the form of eyes. The children's shoehorn comes in different sizes to accommodate different sizes of children's shoes.

15 Claims, 2 Drawing Sheets

CHILDREN'S SHOEHORN

BACKGROUND OF THE INVENTION

1. Field of the Invention

The present invention relates to a children's shoehorn for use in connection with assisting parents when dressing an infant or young child. The children's shoehorn has particular utility in connection with putting on an infant's or young child's shoes.

2. Description of the Prior Art

Shoehorns are desirable for making putting shoes on easier. The use of other shoehorns and musical devices is known in the prior art. For example, U.S. Pat. No. 5,212,333 to Aryee discloses a musical and illuminated baton. However, Aryee '233 makes no provision for application of music and illumination to a device useful for aiding parents in dressing small children.

U.S. Pat. No. 1,522,922 to Smiley discloses a shoehorn that is wide at one end and narrow at the other. However, Smiley '922 does not disclose a shoehorn with a character to appeal to children at the end opposite the shoehorn nor a shoehorn that fits the heel of an infant or child.

U.S. Pat. No. 728,788 to Washington discloses a shoehorn that is wide at one end and flexible. However, Washington '788 does not disclose a shoehorn with a character to appeal to children at the end opposite the shoehorn nor a shoehorn that fits the heel of an infant or child.

U.S. Pat. No. 1,710,138 to Bartholomae discloses a shoehorn with a tongue and a finger loop. However, Bartholomae '138 does not disclose a shoehorn with a character to appeal to children at the end opposite the shoehorn nor a shoehorn that fits the heel of an infant or child.

U.S. Pat. No. 3,436,000 to Batista discloses a shoehorn with a wide end and curved handle. However, Batista '000 does not disclose a shoehorn with a character to appeal to children at the end opposite the shoehorn nor a shoehorn that fits the heel of an infant or child.

While the above-described devices fulfill their respective, particular objectives and requirements, the aforementioned patents do not describe a shoehorn that aids parents in putting on an infant's or child's shoes. The abovementioned patents make no provision for a shoehorn to accommodate an infant's or child's foot and no provision for a shoehorn with a character or the like to appeal to children at the end opposite the shoehorn.

Therefore, a need exists for a new and improved children's shoehorn which can be used for assisting parents when dressing an infant's or young child's shoes. In this regard, the present invention substantially fulfills this need. In this respect, the children's shoehorn according to the present invention substantially departs from the conventional concepts and designs of the prior art, and in doing so provides an apparatus primarily developed for the purpose of assisting parents when putting on an infant's or young child's shoes.

SUMMARY OF THE INVENTION

In view of the foregoing disadvantages inherent in the known types of shoehorns now present in the prior art, the present invention provides an improved children's shoehorn, and overcomes the above-mentioned disadvantages and drawbacks of the prior art. As such, the general purpose of the present invention, which will be described subsequently in greater detail, is to provide a new and improved children's shoehorn which has all the advantages of the prior art mentioned heretofore and many novel features that result in a shoehorn which is not anticipated, rendered obvious, suggested, or even implied by the prior art, either alone or in any combination thereof.

To attain this, one embodiment of the shoehorn of the present invention essentially comprises a lower heel-engaging portion and an upper portion in a shape suitable for children. The shoehorn maybe sized for an infant's or child's heel. The shoehorn may produce means for producing sound. The means for producing sound may be a circuit comprising: a switch, a battery, a speaker, and a microprocessor comprising a memory that enables a song or other distinctive sound to be emitted from the speaker. The circuit of the shoehorn may further comprises at least one light or two lights in the form of eyes. The upper portion of the shoehorn may be in the shape of a logo, geometric shape, character or animal.

A second embodiment of the shoehorn of the present invention essentially comprises a lower heel-engaging portion sized for an infant's or child's heel and an upper portion in a shape suitable for children. The shoehorn may produce means for producing sound. The means for producing sound may be a circuit comprising: a switch, a battery, a speaker, and a microprocessor comprising a memory that enables a song or other distinctive sound to be emitted from the speaker. The circuit of the shoehorn may further comprises at least one light or two lights in the form of eyes. The upper portion of the shoehorn may be in the shape of a logo, geometric shape, character or animal.

Another embodiment of the shoehorn of the present invention essentially comprises a lower heel-engaging portion and means for, producing sound. The shoehorn may have a lower heel-engaging portion is sized for an infant's or child's heel. The means for producing sound may be a circuit comprising: a switch, a battery, a speaker, and a microprocessor comprising a memory that enables a song or other distinctive sound to be emitted from the speaker. The circuit of the shoehorn may further comprise at least one light or two lights in the form of eyes. The upper portion of the shoehorn may be in a shape suitable for children. The upper portion may comprise lights in the form of eyes. The lights may be lightable via a circuit comprising a switch, a battery and lights. The circuit may further comprises a speaker and a microprocessor comprising a memory that enables a song or other distinctive sound to be emitted from the speaker. The upper portion maybe in a shape of a logo, geometric shape, character or animal.

To attain this, one embodiment of the present invention essentially comprises a shoehorn having a lower heel-engaging portion sized for an infant's or child's heel and an upper portion in a shape suitable for children. The children's shoehorn may also comprise a circuit to play a song or other distinctive sound to be emitted from the speaker and/or light lights. The upper portion in a shape suitable for children may further comprise lights in the form of eyes. The upper portion of the children's shoehorn may be a logo, geometric shape, character, animal or form.

There has thus been outlined, rather broadly, the more important features of the invention in order that the detailed description thereof that follows may be better understood and in order that the present contribution to the art may be better appreciated.

The invention may also include children's shoehorn in different colors, different construction materials, with different characters and different sized shoehorns to accommodate a growing child's foot. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved children's shoehorn that has all of the advantages of the prior art shoehorns and none of the disadvantages.

It is another object of the present invention to provide a new and improved which may be easily and efficiently manufactured and marketed.

It is further object of the present invention to provide a new and improved children's shoehorn which is of a durable and reliable construction.

An even further object of the present invention is to provide a new and improved children's shoehorn which is susceptible of a low cost of manufacture with regard to both materials and labor, and which accordingly is then susceptible of low prices of sale to the consuming public, thereby making such shoehorn economically available to the buying public.

Still another object of the present invention is to provide a children's shoehorn that provides in the apparatuses and methods of the prior art some of the advantages thereof, while simultaneously overcoming some of the disadvantages normally associated therewith.

Even still another object of the present invention is to provide a children's shoehorn to fulfill the need for an accessory that would ease the task of putting on an infant's or child's shoes for child and parent.

Another object of the present invention is to provide a children's shoehorn that may extend the life of a shoe by easing an infant's or child's foot into a shoe thereby avoiding pushing on the back of the shoe when dressing the child.

Still another object of the present invention is to provide a children's shoehorn that prevents potential injury to a small ankle or foot that may occur if undue pressure is used in an attempt to force an infant's or child's foot into a shoe.

Yet another object of the present invention is to provide a children's shoehorn in different sizes to accommodate shoe sizes from infant's size 1 to children's size 6 and beyond.

Another object of the present invention is to provide a children's shoehorn in the shape of a character, animal, logo, and geometric shape or form appropriate for children.

Yet another object of the present invention is to provide a children's shoehorn that plays a song or other distinctive sound to be emitted from a speaker when a button on the back of the children's shoehorn is depressed.

Still yet another object of the present invention is to provide a children's shoehorn having a character that has eyes that light up.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
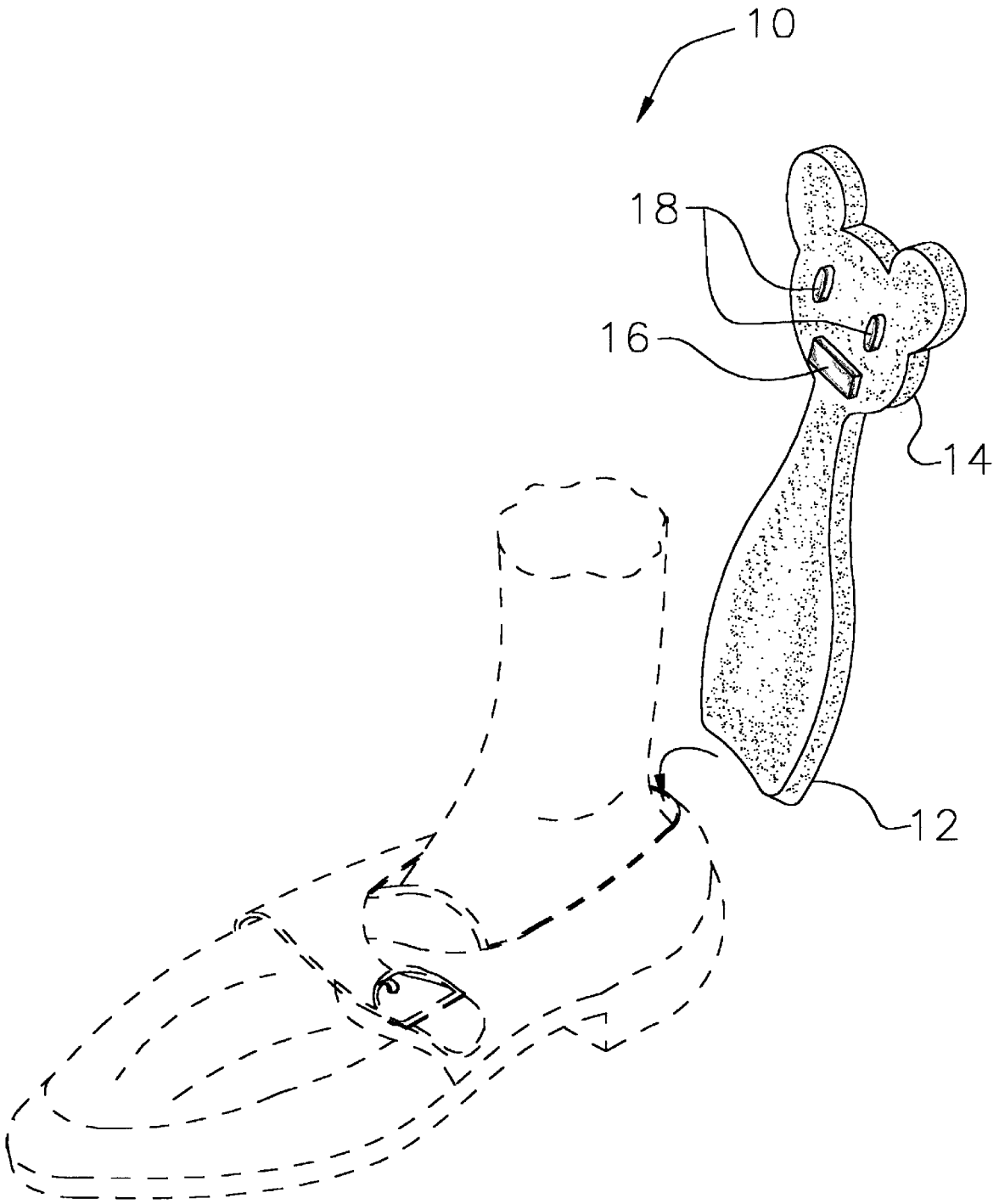
FIG. 1 is a perspective view of the preferred embodiment of the children's shoehorn constructed in accordance with the principles of the present invention.

Referring now to the drawings, particularly FIGS. 1–4, a preferred embodiment of the children's shoehorn of the present invention is shown and generally designated by the reference numeral 10 will be described.

In FIG. 1, a new and improved children's shoehorn 10 of the present invention for assisting parents in putting on an infant's or child's shoe is illustrated and will be described. More particularly, the children's shoehorn 10 has a lower heel portion 12 that may be sized to engage an infant's or child's heel and an upper portion that may be in the shape 14 suitable for children. The upper portion in a shape suitable for children 14 may comprise eyes 18 that may light and a battery 16. The children's shoehorn is used to slide an infant's or child's foot smoothly and gently into a shoe. The toes of an infant or child are inserted into a shoe, the lower heel portion 12 of the children's shoehorn is slipped under an infant's or child's heel. The infant's or child's heel could then be gently slid into the shoe, represented in FIG. 1 by a dotted line, using the children's shoehorn as a guide. The children's shoehorn would then be extracted. Numerous embodiments of the present invention are envisioned. The shoehorn may comprise a lower heel portion 12 and have no shape in the upper portion. The shoehorn of the present invention may comprise a lower heel portion and upper portion in a shape suitable for children without the sound and light enabling circuit.

Figure 2:
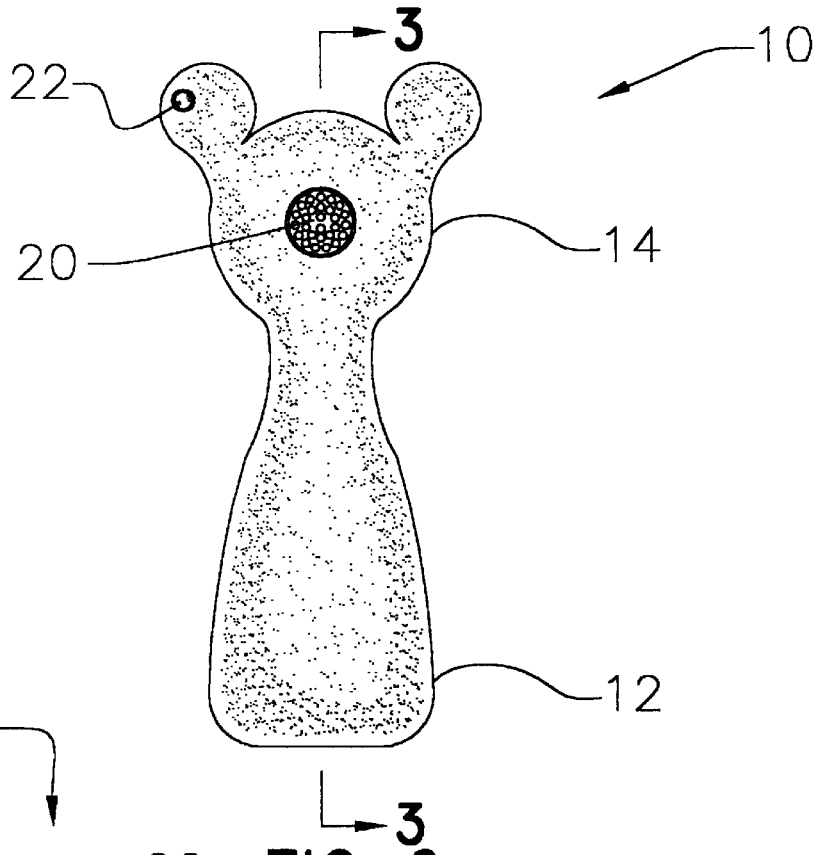
FIG. 2 is a perspective view of the back of the children's shoehorn of the present invention.

FIG. 2 shows the back of the children's shoehorn of the present invention. Shown on the back of the upper portion 14 of the children's shoehorn, is a speaker 20 to play music or the like when a button 22 also located on the back of the children's shoehorn is pressed. Embodiments of the shoehorn wherein the speaker 20 and button 22 are placed on a shoehorn in any shape are envisioned.

Figure 3:
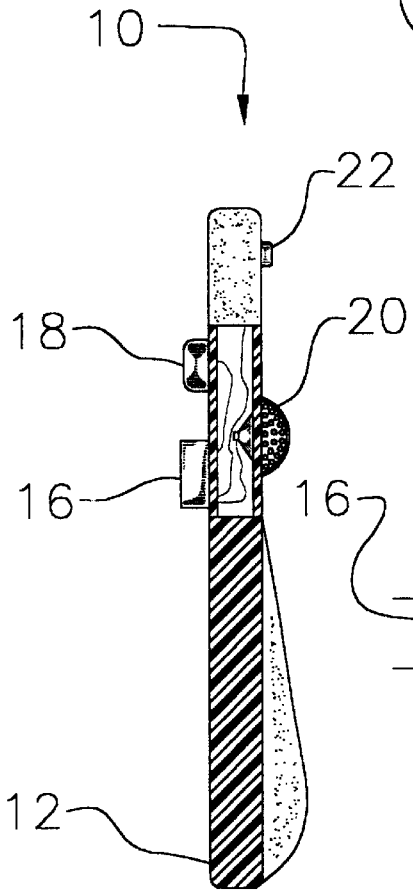
FIG. 3 is cross-sectional view of the children's shoehorn of the present invention taken along the 3—3 axis of FIG. 2.

FIG. 3 shows a cross-sectional view of the children's shoehorn of the present invention taken along the 3—3 axis of FIG. 2. The upper portion of the children's shoehorn of the present invention may comprise eyes 18 that may light, a battery 16, a speaker 20, a button 22 which may activate the lights and microprocessor comprising a memory that enables a song or other distinctive sound to be emitted from a speaker, not shown, so as to play a sound, such as music or the like.

Figure 4:
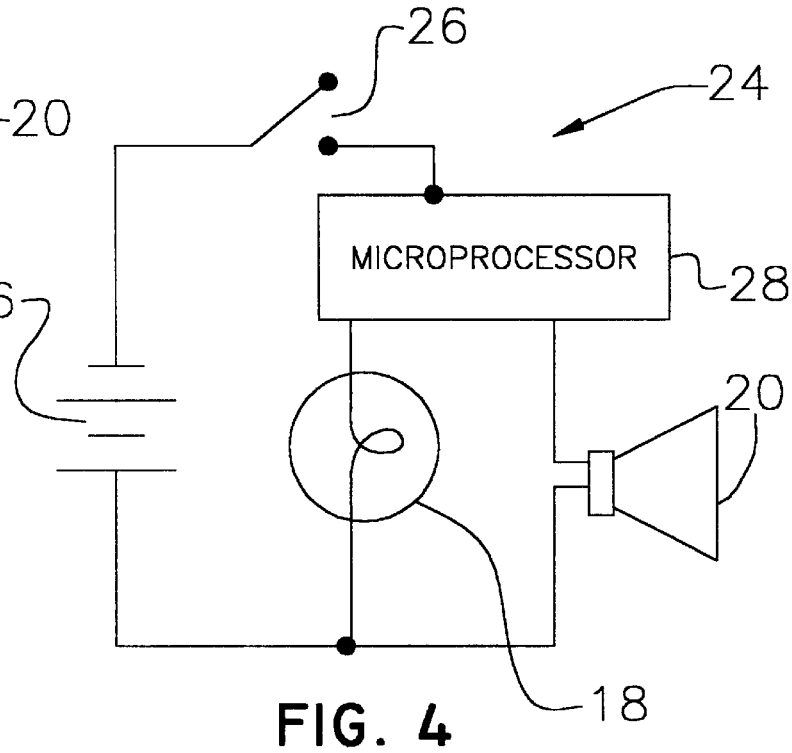
FIG. 4 is a schematic view of the circuit of the children's shoehorn of the present invention.

Turning now to FIG. 4, a schematic of the current embodiment of the circuit 24 of the shoehorn is shown. The circuit 24 comprises a switch 26 providing an electrical connection between a battery 16 and a microprocessor 28. The switch 26 could be a simple pressure-activated button, a transducer or another type of small readily available switch. In the current embodiment, the circuit 24 is one when the switch is close, or activated or depressed, and the circuit 24 is off when the switch is open or not depressed. The microprocessor 28 may be a simple logic chip, or may contain a memory that holds a specific sound to be emitted by the speaker 20. The microprocessor 28 may optionally be connected to a light 18 and a speaker 20. The light 18 and speaker 20 are connected in parallel to the battery 16 in order to complete the circuit 24 when the switch 26 is closed, or in the "on" position. When the switch 26 is in the open position, power from the batter 16 does not flow to the microprocessor, so power is conserved and the light 18 and speaker 20 are inactive. When the switch 26 is in the closed position, such as when a simple button-switch is depressed. Power flows to the microprocessor 28, and the microprocessor 28 causes the speaker 20 to sound and the light 18 to glow. As previously noted, the microprocessor 28 of the current embodiment comprises a memory that enables a song or other distinctive sound to be emitted from the speaker 20 when the switch 26 is closed. The microprocessor 28 may also cause the lights 18 of the current embodiment of the shoehorn to flash intermittently or independently. Those trained in the art will also appreciate that the circuit 24 may be simplified. For example, the speaker 20 or the lights 18 may be omitted, or as in the current embodiment, a plurality of lights may be employed. The speaker 20 may also be replaced with a buzzer, such as a piezoelectric buzzer, to produce a buzz, rather than a sound. Using a buzzer rather than a speaker would allow the microprocessor 28, with its associated memory for sound, to be eliminated. Of course, eliminating the microprocessor 28 would further eliminate the control over the light 18, causing the light 18 glow steadily when the switch 26 was closed; in such instance, if a blinking light is desired, the light 18 could be replaced with a flasher bulb. Rather than a bulb, an LED may be used for the light 18 in order to ensure longevity. Aside from the variations herein explained, those trained in the art will readily recognize that other variations of the circuit are possible without deviating from the spirit and scope of the invention: for example, the speaker 20 and light 18 may be in series, rather than in parallel.

As shown in FIGS. 1–3, the children's shoehorn of the present invention may comprise a battery 16 operated speaker 20 to play a song or other distinctive sound to be emitted from a speaker from a microprocessor comprising a memory that enables a song or other distinctive sound to be emitted from a speaker when a button 22 is pressed. The character shape 14 of the children's shoehorn may have eyes 18 that light when the button 22 is pressed.

In use, it can now be understood that the toes of an infant or child are inserted into a shoe, the lower heel portion 12 of the children's shoehorn is slipped under an infant's or child's heel. The infant's or child's heel could then be gently slid into the shoe using the children's shoehorn as a guide. The children's shoehorn would then be extracted. The button on the back of the children's shoehorn 22 may be pressed at any time to distract or entertain the infant or child with lights and song while putting on their shoes.

The children's shoehorn of the present invention is designed to accommodate an average infant's or child's heel. The children's shoehorn may have a curve to accommodate the infant's or child's heel. The children's shoehorn could be available in different sizes, such as small, medium, large and extra large. The children's shoehorn could fit shoes from infant size 1 up to children's size 6 and beyond. The shoehorn may be padded or of any suitable shape or material.

The lower heel portion 12 of the children's shoehorn of the present invention may be flexible or firm. The lower heel portion has a curve to accommodate an average infant's or child's heel. The upper portion of the children's shoehorn maybe formed of an appropriate shape, character, form, animal or logo. For example a bear shape or sports team logo. The children's shoehorn may be of any color and made of any suitable material such as plastic or metal. Similarly, the batter, speaker, eye lights and button configuration of the children's shoehorn may be of any suitable shape or form to permit reliable sound quality and affordable manufacture.

While preferred embodiments of the children's shoehorn of the present invention have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material may be used instead of the plastic or metal described. It should be appreciated that the children's shoehorn may come in several different sizes to accommodate different sized feet and may come with several different colors and characters or shapes.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A shoehorn comprising:

a lower heel-engaging portion;

a pressure-activated switch that is activated when said heel-engaging portion is engaged; and a sound-emitting circuit connected to said switch that emits a sound when said switch is activated.

2. The shoehorn of claim 1, wherein the lower heel-engaging portion is sized for an infant's or child's heel.

3. The shoehorn of claim 1, further comprising an upper portion wherein said upper portion shape is selected from the group consisting of a logo, geometric shape, character design and animal shape.

4. The shoehorn of claim 1 further comprising a light connected to said switch that lights when said switch is activated.

5. A shoehorn comprising:

a lower heel-engaging portion sized for an infant's or child's heel;

an upper portion in a shape suitable for children, and a sound-emitting circuit comprising:

a battery;

a speaker; and a switch having an on position and an off position connected to said speaker and to said battery, wherein an electrical connection between said speaker and said battery is formed when said speaker is in said on position.

6. The shoehorn of claim 5 wherein said speaker is a buzzer.

7. The shoehorn of claim 5 wherein said sound-emitting circuit further comprises a memory connected to said speaker that enables a song or other distinctive sound to be emitted from said speaker.

8. The shoehorn of claim 5, wherein the circuit further comprises:

a light connected to said switch, wherein an electrical connection between said light and said battery is formed when said speaker is in said on position.

9. The shoehorn of claim 5 wherein said switch is pressure-activated.

10. The shoehorn of claim 5 wherein said switch consists of contact-activated.

11. The shoehorn of claim 8 wherein said light is in the form of an eye on said upper portion.

12. A shoehorn comprising:

a lower heel-engaging portion sized for an infant's or child's heel;

an upper portion in a shape suitable for children; and a light-emitting circuit comprising a battery; a light; and a switch having an on position and an off position connected to said light and to said battery, wherein an electrical connection between said light and said battery is formed when said speaker is in said on position thereby causing said light to emit light.

13. The shoehorn of claim 12 wherein said light is a light emitting diode.

14. The shoehorn of claim 12, wherein said circuit further comprises a speaker connected to said switch, wherein an electrical connection between said speaker and said battery is formed when said speaker is in said on position.

15. The shoehorn of claim 14 further comprising a memory connected to said speaker that enables a song or other distinctive sound to be emitted from the speaker.

* * * * *